US007526840B2

(12) United States Patent
Pernu et al.

(10) Patent No.: US 7,526,840 B2
(45) Date of Patent: May 5, 2009

(54) STRAP ATTACHMENT ASSEMBLY

(75) Inventors: Kimmo Pernu, Espoo (FI); Phillip Lindberg, Helsingfors (FI); Jukka Manni, Helsinki (FI)

(73) Assignee: Suunto Oy, Vantaa (FI)

( * ) Notice: Subject to any disclaimer, the term of this patent is extended or adjusted under 35 U.S.C. 154(b) by 364 days.

(21) Appl. No.: 11/354,914

(22) Filed: Feb. 16, 2006

(65) Prior Publication Data

US 2006/0180000 A1 Aug. 17, 2006

(30) Foreign Application Priority Data

Feb. 17, 2005 (FI) ..... 20050189

(51) Int. Cl.
*G04B 37/14* (2006.01)
*A44C 5/14* (2006.01)

(52) U.S. Cl. ..... 24/265 WS; 24/629

(58) Field of Classification Search ..... 24/265 WS, 24/265 R, 265 BC, 265 EC, 633, 629, 639, 24/68 J, 71 J; 368/282
See application file for complete search history.

(56) References Cited

U.S. PATENT DOCUMENTS 3,763,523 A * 10/1973 Lindblad ..... 24/639
3,774,268 A 11/1973 Holmberg
3,955,056 A * 5/1976 Lindblad ..... 200/61.58 B
4,543,694 A * 10/1985 Fohl ..... 24/656
4,597,138 A * 7/1986 Hirsch ..... 24/265 B
5,119,532 A * 6/1992 Tanaka ..... 24/641
5,341,552 A * 8/1994 Voumard ..... 29/896.33
6,408,490 B1 * 6/2002 Pequignet ..... 24/265 WS
6,408,491 B2 * 6/2002 Guyard ..... 24/265 WS
6,748,631 B2 * 6/2004 Iguchi et al. ..... 24/265 WS
2002/0133920 A1 9/2002 Hodge

FOREIGN PATENT DOCUMENTS

FR 1 409 848 A 9/1965
FR 1409848 * 9/1965

* cited by examiner

*Primary Examiner*—Robert J Sandy
(74) *Attorney, Agent, or Firm*—Birch, Stewart, Kolasch & Birch, LLP

(57) ABSTRACT

An assembly is disclosed for mounting a strap to a sports instrument, the assembly includes a mounting element situated in the strap, a slot situated in the sports instrument for accommodating the mounting element and fixing member for securing the mounting element in the slot. The fixing member includes a spring-loaded locking element capable of reaching into the slot and, cooperating with the same, a retaining element, whereby the locking element functions in conjunction with the sports element while the retaining element functions in conjunction with the mounting element.

3 Claims, 2 Drawing Sheets

STRAP ATTACHMENT ASSEMBLY

CROSS-REFERENCE TO RELATED APPLICATION

The present application claims priority under 35 U.S.C. §119 to Finnish Patent Application No. 2005-0189, filed Feb. 17, 2005, the entire contents of which are hereby incorporated by reference.

BACKGROUND OF THE INVENTION

1. Field of the Invention

The invention relates to a strap attachment assembly.

2. Description of Background Art

Human body functions may be monitored during a sports or physical activity session by means of a wrist computer or other like sports instrument. Typically, a wrist computer incorporates a pulse-sensing transmitter belt attachable by a flexible strap to the human body. Such a measurement unit equipped with electrodes sends the measurement signal wirelessly to a wristwatch-like computer wherein at least a portion of the received signal is processed and visualized on the computer display. In addition to pulse monitoring, wrist computers may be used for measuring blood pressure, velocity, acceleration, distance traveled, step count and directional data.

A sports instrument is complemented with a strap by means of which the instrument is attached on the user's wrist or other location of use. As the strap is assumed to have different properties in different operating conditions and sites, the strap shall be replaceable as necessary. For instance, the strap of a sports instrument to be fit over a coat sleeve must obviously be longer than a strap fittable on the wrist. In heavy sports activities the strap must be as non-sweating as possible. In the case that the sports instrument is attached to, e.g., a bicycle or surfing board, again a different strap suited to the present location of use is needed.

Conventionally, the strap is mounted on the sports instrument with the help of a mechanism similar to that used for attaching a strap to a wrist watch. One embodiment of this kind of mechanism comprises a spring-loaded collapsible pin while the sports instrument incorporates pin holes adapted to receive the pin tips. For mounting and dismounting the strap, the pin is compressed to fit the pin tips into the pin holes of the sports instrument or to remove the tips from the pin holes. Generally, a suitable special tool must be employed to compress the pin thus resulting in a complicated and time-consuming strap replacement.

SUMMARY AND OBJECTS OF THE INVENTION

It is an object of the present invention to provide an attachment assembly for mounting a strap on a sports instrument and dismounting the strap from the instrument in an uncomplicated and rapid fashion.

The goal of the invention is attained by such mounting means of the strap that comprise a spring-loaded locking element adapted to reach into a peg hole provided in the sports instrument and a retaining element cooperating with the same. The locking element is adapted to the sports instrument and, respectively, the retaining element to a mounting element.

The invention provides significant benefits.

The mounting assembly according to the invention permits simple and quick replacement of a strap on a sports instrument as required by a specific application and location of use. The strap attachment assembly according to the invention also offers a design of high reliability and simple construction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is examined in more detail with the help of an exemplifying embodiment illustrated in the appended drawings in which.

DETAILED DESCRIPTION OF THE PREFERRED. EMBODIMENTS

Figure 1:
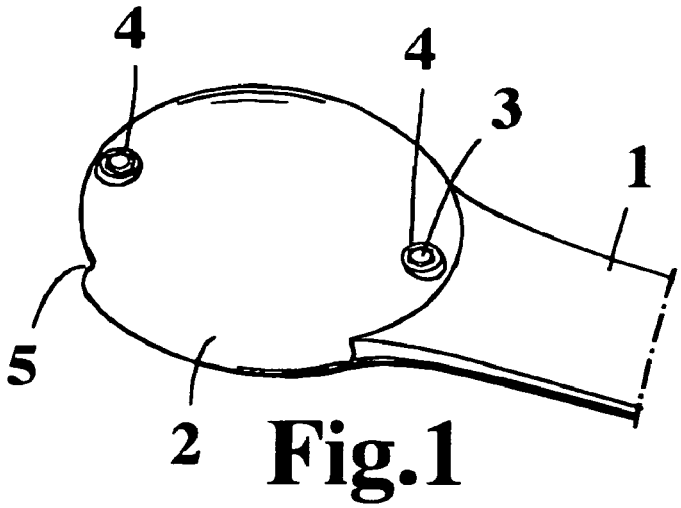
FIG. 1 shows a sports instrument having a strap attached to its side.
Figure 2:
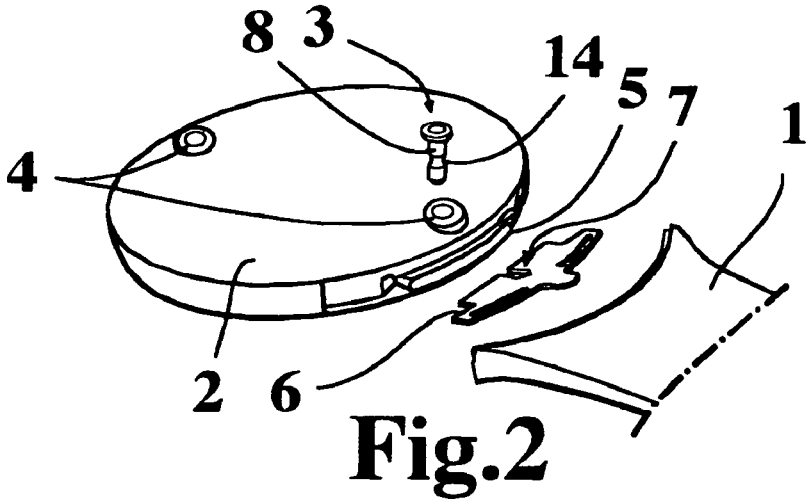
FIG. 2 shows the sports instrument of FIG. 1 with a strap and a mounting element with a locking element suited for attaching the strap.

Referring to FIG. 1, a sports instrument 2 illustrated therein has attached to its side a strap 1 suitable for securing the sports instrument onto its intended location of use, e.g., a wrist, body, coat sleeve, bicycle, surfing board or the like. Generally, also the opposite side of the sports instrument 2 has a compatible strap tail attached thereto. The sports instrument may be, e.g., a sensor adapted to monitor the user's physiological functions (e.g., pulse, blood pressure) or motion (e.g., velocity, acceleration, distance traveled, step count or directional data) during a sports or motion activity or, alternatively, a wrist-worn computer suited to process the measurement data and visualize the same on the display of the computer. As to its look, the wrist-worn computer is similar to a wrist watch thus being suited for fitting on the user's wrist by a strap similar to that of a wrist watch.

The strap 1 has attached thereto a mounting element serving to secure the strap to the sports instrument 2. In the embodiment shown in the diagrams, the mounting element is a metallic mounting plate 6. Typically, the strap 1 is made from a polymeric material, e.g., thermoplastic polyurethane (TPU). The mounting plate 6 is fixed in a permanent fashion to the strap by injection molding, for instance. The side of the sports instrument 2 has a slot 5 suited to accommodate the mounting plate 6. The mounting plate 6 is inserted into slot 5 when strap 1 is being fitted on the sports instrument 2.

The upper surface of the sports instrument 2 has a peg hole 4 reaching into slot 5. Into peg hole 4 is adapted a spring-loaded locking element for securing the mounting plate 6 in slot 5. In the embodiment shown in the diagrams, the locking element is a cylindrical, spring-loaded peg 3. The top end of peg 3 carries a knob 13 with a diameter larger than that of the peg shaft. About the shaft of peg 3 is fitted a spring 8 serving as the loading element of peg 3. The spring 8 is a compression-type spring. Having peg 3 fitted in peg hole 4, spring 8 is situated in the gap between knob 13 and a collar 12 of peg hole 4. The shaft of peg 3 is provided with an annular recess groove 14 at which the shaft diameter is smaller than that over the rest of the shaft.

The mounting plate 6 is provided with a retaining element cooperating with the spring-loaded locking element to secure locking plate 6 in slot 5. In the embodiment shown in the diagrams, the retaining element is a circular opening 7 made in the locking plate 6 and dimensioned to accommodate the shaft of peg 3. The mounting plate 6 is also equipped with a gap 11 extending from the front edge of mounting plate 6 to peg opening 7. The width of gap 11 is narrower than the diameter of peg opening 7 and of the shaft of peg 3 below recess groove 14. However, the width of gap 11 is made larger than the diameter of peg 3 at recess groove 14. The width of recess groove 14 is larger than the thickness of mounting plate 6 at peg opening 7 and gap 11.

At both edges of gap 11, mounting plate 6 is shaped to have a slanted surface 10 extending from the front edge of mounting plate 6 up to peg opening 7. The slanted surfaces 10 are tilted toward to the front edge of mounting plate 6. At peg opening 7, the slanted surface 10 is situated at the top side level of mounting plate 6.

Figure 3:
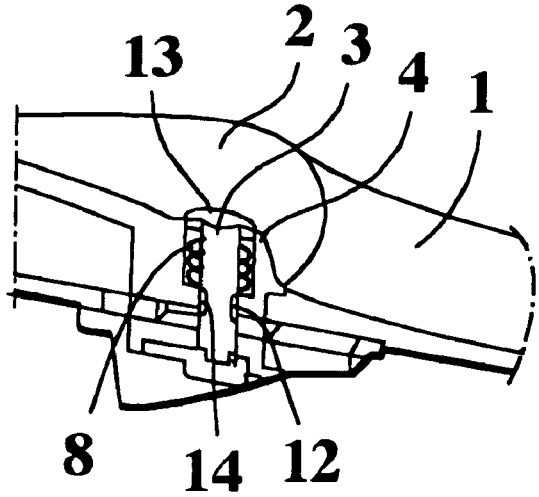
FIG. 3 shows a cross-sectional view of the sports instrument of FIG. 1 and the attachment point of the strap thereon.
Figure 4:
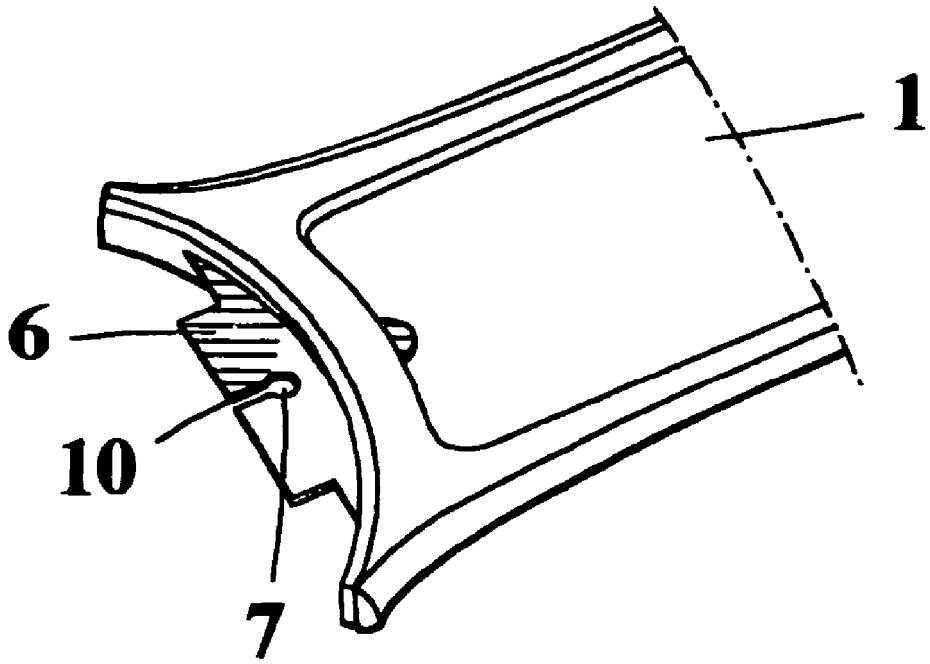
FIG. 4 shows the strap of FIG. 1 with the mounting element attached thereto.
Figure 5:
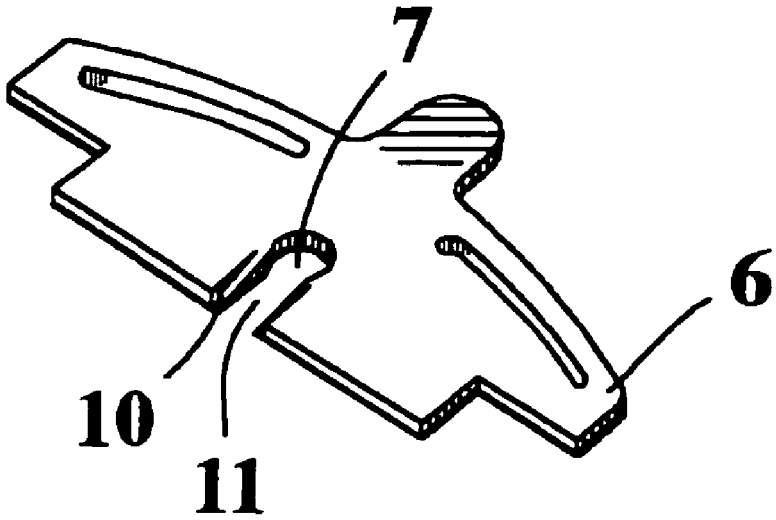
FIG. 5 shows the mounting element of FIG. 4.

Strap 1 is attached to sports instrument 2 such that mounting plate 6 is inserted into slot 5, whereby the slanted surfaces 10 meet the lower shaft portion of peg 3. As mounting plate 6 is inserted deeper into slot 5, peg 3 rises upward when slanted surfaces 10 slide along the bottom surface of peg 3. With further insertion of mounting plate 6 deeper into slot 5, the bottom surface of peg 3 rises to the top side level of mounting plate 6, whereupon peg 3 enters peg opening 7 thus securing strap 1 to the sports instrument 2 (FIG. 3). Inasmuch as the diameter of the portion of peg 3 now resting in peg opening 7 is larger than the diameter of gap 11, peg 3 thus secures mounting plate 6 into slot 5.

Strap 1 is detached from sports instrument 2 by pressing the knob of peg 3 by, e.g., a finger nail or a suitable thin tool (match, pen tip or the like) so that the recess groove 14 is moved to coincide with the peg opening 7 of mounting plate 6 and recess groove 11, whereupon mounting plate 6 can be withdrawn from slot 5 of the sports instrument 2.

The invention may have embodiments different from that described above. The mounting assembly can be implemented such that the detachment of the strap from the sports instrument takes place by pulling the peg upward by, e.g., a grip attached to the knob. The mounting assembly (peg and mounting plate) may have a construction located in a position disposed 90° from that described above. Then, the peg is adapted into a peg hole at the side of the sports instrument. Respectively, the mounting plate is situated in the strap such that, at the insertion of the strap end into the slot of the sports instrument, the peg moves laterally thus securing the mounting plate in the slot. The detachment of the strap from sports instrument takes place by pulling or depressing the peg. The instrument can be attached to a plurality of different elements by means of a single, similar assembly. Particularly, each point of attachment can use similar mounting element compatible with the instrument.

What is claimed is:

1. An assembly for securing a strap to a sports instrument, the assembly comprising:

a mounting element situated in the strap, a slot situated in the sports instrument for accommodating the mounting element, and fixing means for securing the mounting element in the slot, the fixing means comprises a spring-loaded locking element capable of reaching into the slot and, cooperating with the same, and a retaining element, wherein said locking element is adapted in conjunction with the sports instrument while said retaining element is adapted in conjunction with the mounting element, and wherein the locking element is a spring-loaded peg comprising a recess groove, and said mounting element has a gap that reaches to the retaining element, the gap having a width that is narrower than a diameter of the retaining element and of a shaft of the peg below the recess groove; and wherein said mounting element is detachable from said slot by way of depressing said locking element.

2. The assembly of claim 1, wherein the retaining element is a peg opening made in said mounting element adapted to accommodate the insertion of said locking element therein when said mounting element is inserted into the slot.

3. The assembly of claim 2, wherein said mounting element is provided with a slanted surface adapted to slide along said locking element when said mounting element is being inserted into said the slot.

* * * * *